US006605988B1

(12) United States Patent
Gauthier et al.

(10) Patent No.: US 6,605,988 B1
(45) Date of Patent: Aug. 12, 2003

(54) LOW VOLTAGE TEMPERATURE-INDEPENDENT AND TEMPERATURE-DEPENDENT VOLTAGE GENERATOR

(75) Inventors: Claude Gauthier, Fremont, CA (US); Brian Amick, Austin, TX (US); Spencer Gold, Pepperell, MA (US); Kamran Zarrineh, Billerica, MA (US)

(73) Assignee: Sun Microsystems, Inc., Santa Clara, CA (US)

( * ) Notice: Subject to any disclaimer, the term of this patent is extended or adjusted under 35 U.S.C. 154(b) by 0 days.

(21) Appl. No.: 10/078,140

(22) Filed: Feb. 19, 2002

(51) Int. Cl.[7] ..... G05F 1/46; G05F 1/567
(52) U.S. Cl. ..... 327/541; 327/539
(58) Field of Search ..... 327/512, 538, 327/539, 540, 541, 542, 543; 323/280, 313, 314, 315, 316, 901, 907; 307/72

(56) References Cited

U.S. PATENT DOCUMENTS 6,150,872 A * 11/2000 McNeill et al. ..... 327/539
6,242,898 B1 * 6/2001 Shimizu et al. ..... 323/313
6,363,612 B1 * 4/2002 Roberts et al. ..... 323/313
6,384,586 B1 * 5/2002 Sugawara ..... 323/313

OTHER PUBLICATIONS

"Remote/Local Temperature Sensor with SMBus Serial Interface" Maxim MAX1617 19–1265; Rev 1: 3/98, pp. 1–20.

"2–Wire Digital Termometer and Thermostat" Dallas Semiconductor DS1721 Dec. 29, 1998, pp. 1–14.

"High Resolution Temperature Measurement with Dallas Direct–to–Digital Temperature Sensors" Dallas Semiconductor Application Note 105, pp. 1–20.

"Intel Pentium 4 Processor in the 423–pin Package Termal Design Guidelines" Order No. 249203–001 Nov., 2000, pp. 1–28.

* cited by examiner

*Primary Examiner*—Timothy P. Callahan
*Assistant Examiner*—Terry L. Englund
(74) *Attorney, Agent, or Firm*—Rosenthal & Osha L.L.P.

(57) ABSTRACT

A method for using a low voltage power supply to generate a temperature-independent voltage and temperature-dependent voltage is provided. Further, an apparatus that uses a low voltage power supply to generate a temperature-independent voltage and temperature-dependent voltage is provided. The apparatus generates a temperature-dependent voltage and a temperature-independent voltage using an amplifier stage that generates a feedback signal; a startup stage that generates a startup signal dependent on the feedback signal; and an output stage that outputs the temperature-dependent voltage and the temperature-independent voltage dependent on the feedback and startup signals.

12 Claims, 2 Drawing Sheets

LOW VOLTAGE TEMPERATURE-INDEPENDENT AND TEMPERATURE-DEPENDENT VOLTAGE GENERATOR

This application contains subject matter that may be related to that contained in the following U.S. applications filed on Feb. 19, 2002 and assigned to the assignee of the instant application: "A Method and System for Monitoring and Profiling an Integrated Circuit Die Temperature" (U.S. patent application No. 10/079,476 filed Feb. 19, 2002), "An Integrated Temperature Sensor" (U.S. patent application No. 10/080,037 filed Feb. 19, 2002), "A Controller for Monitoring Temperature" (U.S. patent application No. 10/079,475 filed Feb. 19, 2002), "Temperature Calibration Using On-Chip Electrical Fuses" (U.S. patent application No. 10/078,760 filed Feb. 19, 2002), "Quantifying a Difference Between Nodal Voltages" (U.S. patent application No. 10/078,945 filed Feb. 19, 2002), and "Increasing Power Supply Noise Rejection Using Linear Voltage Regulators in an On-Chip Temperature Sensor" (U.S. patent application No. 10/078,130 filed Feb. 19, 2002).

BACKGROUND OF THE INVENTION

A typical computer system includes at least a microprocessor and some form of memory. The microprocessor has, among other components, arithmetic, logic, and control circuitry that interpret and execute instructions necessary for the operation and use of the computer system. FIG. 1 shows a typical computer system (10) having a microprocessor (12), memory (14), integrated circuits (ICs) (16) that have various functionalities, and communication paths (18), i.e., buses and wires, that are necessary for the transfer of data among the aforementioned components of the computer system (10).

As circuit elements continue to get smaller and as more and more circuit elements are packed onto an IC, ICs (16) dissipate increased amounts of power, effectively causing ICs (16) to run hotter. Consequently, increased operating temperatures create a propensity for performance reliability degradation. Thus, it is becoming increasingly important to know the temperature parameters in which a particular IC operates.

The temperature level in a microprocessor (12) is typically measured by producing a voltage proportional to temperature, i.e., a temperature-dependent voltage. It is also useful to produce a temperature-independent voltage, i.e., insensitive to temperature, that can be processed along with the temperature-dependent voltage to allow for cancellation of process and supply variations. One method of generating a temperature-independent voltage and temperature-dependent voltage is by using a circuit known in the art as a temperature-independent and temperature-dependent voltage generator ("TIDVG"). A TIDVG typically requires a high voltage power supply, e.g., from 2 to 5 volts, in order to function correctly.

TIDVGs typically use both bipolar and MOS transistors. However, as MOS circuit elements used to construct a TIDVG continue to get smaller, scaling constraints imposed by the smaller MOS circuit elements require the use of a lower voltage power supply. Consequently, although a lower voltage power supply is required to power the TIDVG, the amount of voltage required to power devices like bipolar transistors does not decrease. As a result, there is less voltage to power the MOS transistors. Thus, the amount of voltage provided by the lower voltage power supply is not enough to power a TIDVG circuit configuration designed to be powered by a high voltage supply input. Therefore there is a need for a temperature-independent and temperature-dependent voltage generator that can be powered by a low voltage power supply.

SUMMARY OF INVENTION

According to one aspect of the present invention, an apparatus for generating a temperature-dependent voltage and a temperature-independent voltage comprises an amplifier stage that generates a feedback signal; a startup stage that generates a startup signal dependent on the feedback signal; and an output stage that outputs the temperature-dependent voltage and the temperature-independent voltage dependent on the feedback and startup signals.

According to another aspect, an apparatus for generating a temperature-dependent and a temperature-independent voltage comprises means for generating a feedback signal; means for generating a startup signal in relation to the feedback signal; means for generating a temperature-independent voltage in relation to the feedback signal and the startup signal; and means for generating a temperature-dependent voltage in relation to the temperature-independent voltage.

According to another aspect, a method for generating a temperature-dependent voltage and a temperature-independent voltage using a voltage generator having a power supply comprises generating a temperature-independent voltage using at least one temperature-sensitive element; and generating a temperature-dependent voltage in relation to the temperature-independent voltage, wherein the temperature-dependent voltage is generated using a temperature-sensitive element.

According to another aspect, a method for forcing a temperature-dependent and temperature-independent voltage generator out of a no-current state comprises generating a first temperature-sensitive voltage; generating a second temperature-sensitive voltage; generating a feedback signal by comparing the first temperature-sensitive voltage to the second temperature-sensitive voltage; generating a startup signal using the feedback signal; and inputting the startup signal to an output stage.

Other aspects and advantages of the invention will be apparent from the following description and the appended claims.

DETAILED DESCRIPTION

Embodiments of the present invention relate to an apparatus that uses a low voltage power supply to generate a temperature-independent voltage and temperature-dependent voltage. Embodiments of the present invention further relate to method for generating a temperature-independent voltage and temperature-dependent voltage using a low voltage power supply.

Figure 1:
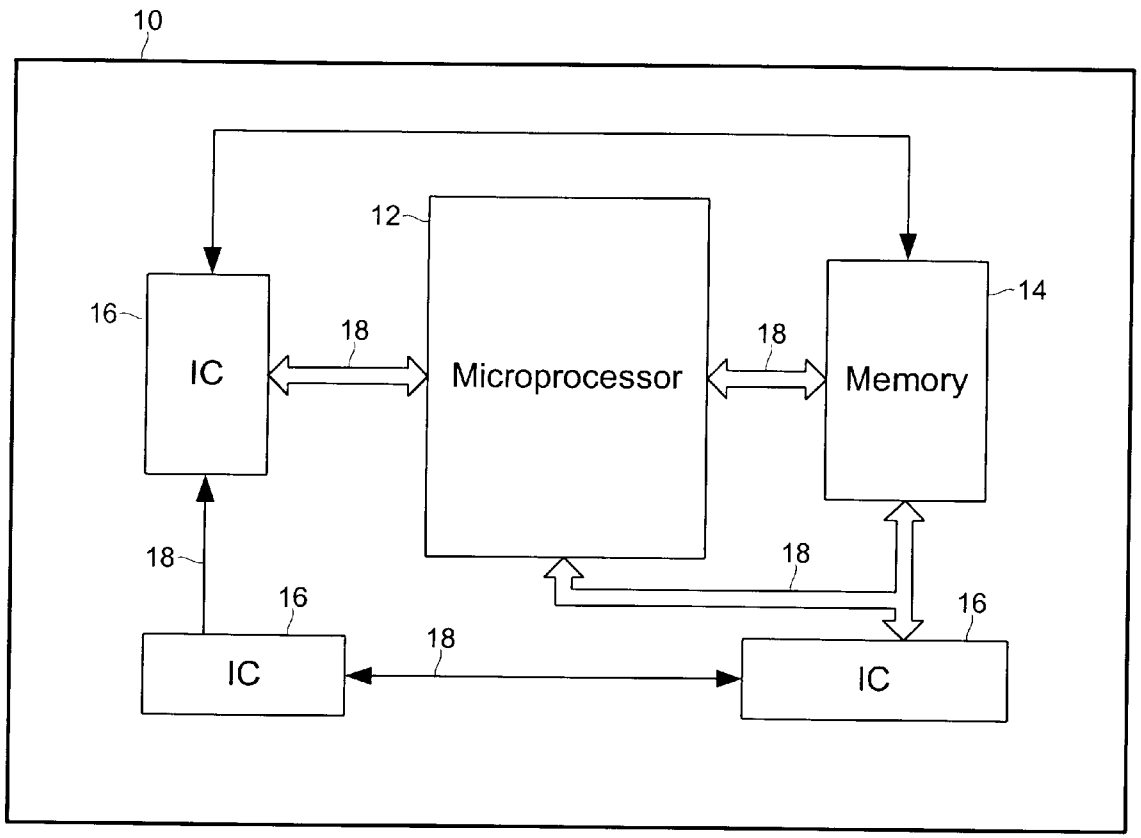
FIGURE 1 (Prior Art)
FIG. 1 shows a typical computer system.
Figure 2:
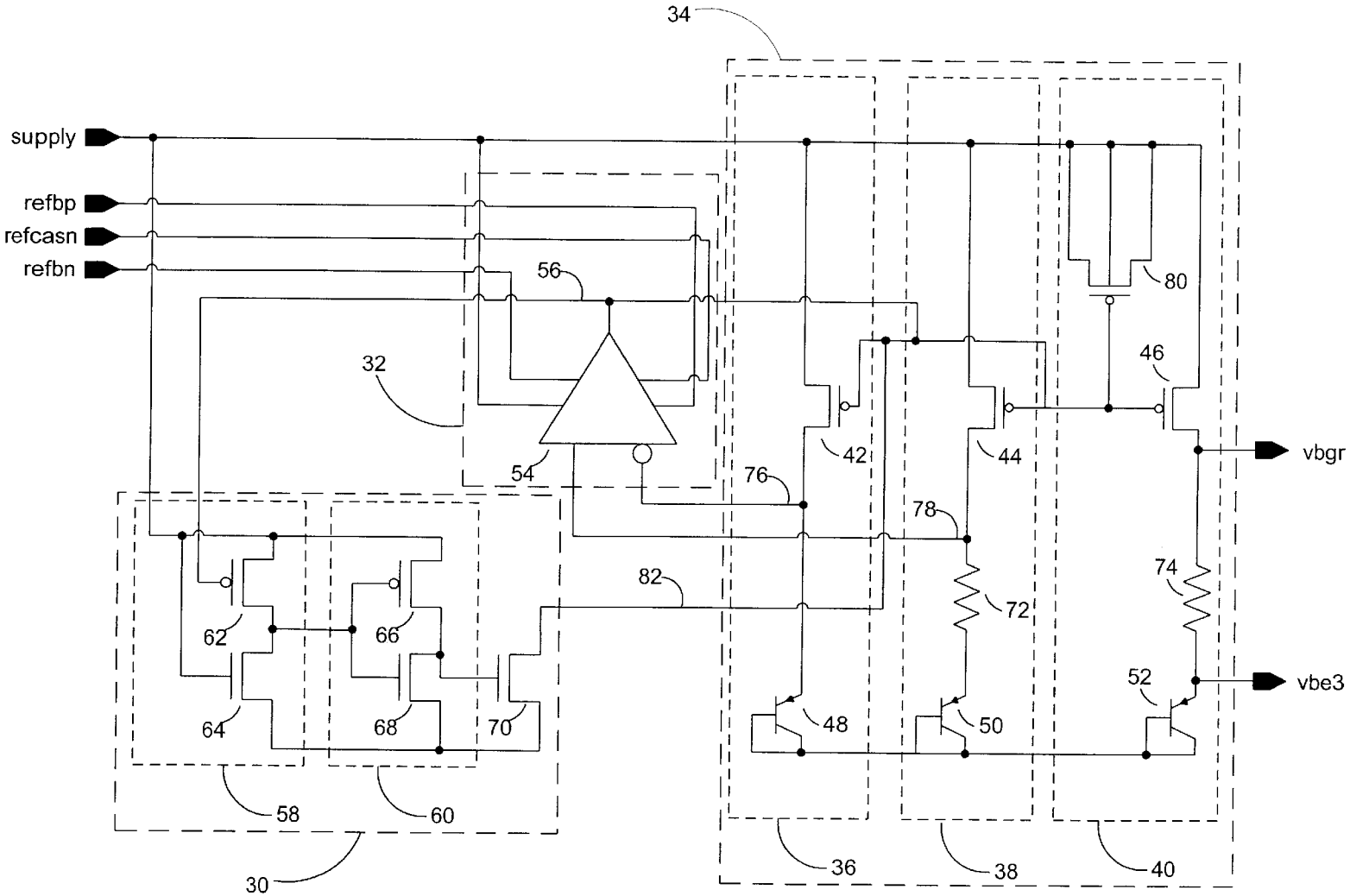
FIG. 2 shows a temperature-independent and temperature-dependent voltage generator in accordance with an embodiment of the present invention.

FIG. 2 shows an exemplary circuit-level schematic of a temperature-independent and temperature-dependent voltage generator ("TIDVG") in accordance with an embodiment of the present invention. In FIG. 2, the TIDVG is shown as being formed by the following stages: a startup stage (30), an amplifier stage (32), and an output stage (34).

The output stage (34) functions as a voltage generator, while the startup stage (30) and the amplifier stage (32) function as support circuitry for the output stage (34). In addition to the circuitry in the aforementioned stages of the TIDVG, the TIDVG has a low voltage power supply (shown in FIG. 2 as 'supply'), amplifier bias inputs (shown in FIG. 2 as 'refbp,' 'refbn,' and 'refcasn') for the amplifier stage (32), and voltage generator outputs (shown in FIG. 2 as 'vbgr' and 'vbe3'). The vbgr output is a temperature-independent voltage, and the vbe3 output is a temperature-dependent voltage. Further, it is important to note that the low voltage power supply has a voltage level less than the conventional voltage values of 1.8 to 5 volts.

The startup stage (30) of the TIDVG is formed by a startup circuit and a feedback signal (56) generated by the amplifier stage (32). The startup circuit has the following elements: a first inverter (58) formed by a first transistor (62) and a second transistor (64), a second inverter (60) (attached to the output of the first inverter (58)) formed by a third transistor (66) and a fourth transistor (68), and a fifth transistor (70) attached to the output of the second inverter (60). The output of the fifth transistor (70), which is also the startup stage output (82), is fed into the output stage (34).

The startup circuit ensures that the output stage (34) operates correctly. The output stage (34) of the TIDVG has two stable operating states: (1) a state in which there is a stable current flow; and (2) a state in which there is no current flow, i.e., a no-current state. The startup circuit ensures that the output stage (34) remains in the first state, i.e., the state in which the current is stable, by monitoring the feedback signal (56) to ensure that the feedback signal (56) does not cause the output stage (34) to remain in the second state, i.e., the no-current state. Whenever the startup circuit senses that the feedback signal (56) input causes or may cause the output stage (34) to enter a no-current state, the inverters (58, 60) and the fifth transistor (70) temporarily act to force the startup circuit's inputs out of the no-current state. Specifically, if the feedback signal (56) is too high, then the input to the second inverter is forced low. This means that the input to the fifth transistor (70) is forced high, which, in turn, forces the startup stage output (82) low. By forcing the startup stage output (82) low, the startup circuit ensures that the TIDVG outputs a valid temperature-independent voltage ('vbgr'), which further ensures that a valid temperature-dependent voltage ('vbe3') is outputted by the TIDVG (discussed below).

The amplifier stage (32) of the TIDVG is formed by an operational amplifier (54). The operational amplifier has the following inputs: supply, refbp, refbn, refcasn, a first branch voltage (76) obtained from the output stage (34), and a second branch voltage (78) also obtained from the output stage (34). The supply signal provides power to the operational amplifier (54), while refbp, refbn, and refcasn serve as bias inputs to the operational amplifier (54). The operational amplifier (54) corrects any err or in voltage between the first and second branch voltages (76, 78). In other words, the operational amplifier (54) seeks to make the difference in voltage between the first branch voltage (76) and the second branch voltage (78) equal to zero, and outputs an error-corrected voltage as the feedback signal (56).

The output stage (34) is formed by the following branches: a first branch (36), a second branch (38), and a third branch (40). The first branch (36), the second branch (38), and the third branch (40) each have a MOS transistor (42, 44, 46) and a bipolar transistor (48, 50, 52). The second branch (38) has a resistor (72), and the third branch (40) has a resistor (74) and a decoupling capacitor (80), wherein the decoupling capacitor (80) is used to remove power supply noise from, i.e. stabilize, the feedback node (56). Those skilled in the art will appreciate that, in some embodiments, the resistors (72, 74) may be implemented using n-well resistors. The transistors (42, 44, 46) are dependent on the supply input, while the bipolar transistors (48, 50, 52) are dependent on inputs from the transistors (42, 44, 46). Each of the transistors (42, 44, 46) functions as a branch current source that produces a current when the input to the transistor is low.

Because the transistors (42, 44, 46) are equal in size, they produce branch source currents that are substantially equal in value. Each bipolar transistor (48, 50, 52) produces a base-emitter voltage ($V_{BE}$) dependent on the size of its emitter area. $V_{BE}$ can be calculated as follows:

$$V_{BE} = \frac{kT}{q}\ln\left(\frac{Ic}{Is}\right), \qquad \text{(Equation 1)}$$

where "k" and "q" represents physical constants, "T" represents the temperature of a bipolar transistor, $I_C$ represents the current through the bipolar transistor's collector, and $I_S$ represents the saturation current of the bipolar transistor.

Together, the first branch (36) and the second branch (38) form a delta-$V_{BE}$ current source. The delta-$V_{BE}$ current source is based on delta-$V_{BE}$, which is the difference between the $V_{BE}$ of the first branch (36) and the $V_{BE}$ of the second branch (38). The value of delta-$V_{BE}$ can be approximated as follows with Equation 2:

$$\Delta V_{BE} = \frac{kT}{q}\ln x, \qquad \text{(Equation 2)}$$

where "k" and "q" represent physical constants, "T" represents the temperature of a bipolar transistor, and "x" is a ratio of the emitter areas of two bipolar transistors. As shown by Equation 2, delta-$V_{BE}$ (also known and referred to as a "differential $V_{BE}$ voltage") is dependent on the ratio "x." Referring to FIG. 2, "x" is a factor representing the difference in area between the emitter of the first branch's (36) bipolar transistor (48) and the emitter of the second branch's (38) bipolar transistor (50). In particular embodiments of the present invention, the emitter areas of the bipolar transistors (48, 50) may differ in size by a factor of 10. This would mean that the emitter area of the second branch's (38) bipolar transistor (50) is 10 times larger than the emitter area of the first branch's (36) bipolar transistor (48).

The first branch voltage (76) is equal to the $V_{BE}$ of the first branch (36), while the second branch voltage is equal to the $V_{BE}$ of the second branch (38) plus the voltage across the second branch's (38) resistor (72). Thus, the second branch voltage (78) may be calculated as follows:

$$BV_2 = V_{BE2} + I_2 R_2, \qquad \text{(Equation 3)}$$

where $BV_2$ represents the second branch voltage (78), $V_{BE2}$ represents the $V_{BE}$ of the second branch (38), $I_2$ represents the current through the second branch's (38) resistor (72), and $R_2$ represents the value of the second branch's (38) resistor (72). Because $R_2$ is a constant value, using the operational amplifier (54) to equalize the first branch voltage (76) and the second branch voltage (78) allows an exact value to be defined for $I_2$.

The third branch (40) uses the delta-$V_{BE}$ current source to generate two outputs: a temperature-independent signal (shown in FIG. 2 as 'vbgr') and a temperature-dependent signal (shown in FIG. 2 as 'vbe3'). The value of the temperature-independent signal is equal to the sum of the temperature-dependent voltage and the voltage drop across resistor (72). The third branch's (40) transistor (46) is equal in size to the second branch's transistor (44). As a result, the current through the third branch's (40) transistor (46) is equal to the current through the second branch's (38) transistor (44) (a technique or effect known as a "current mirror"). In addition, because the temperature-independent signal and the temperature-dependent signal are outputted by the same branch, power supply variations are equally coupled to both signals, allowing for easier supply variation cancellation.

One may show that vbgr is a temperature independent voltage by examining an equation used to calculate the value of vbgr. The value of vbgr can be calculated as follows:

$$vbgr = V_{BE3} + \frac{nxR_1}{mxR_2} \times \frac{kT}{q} \ln x, \qquad \text{(Equation 4)}$$

where "k," "T," "q," and "x" have the same representations as in Equation 2, "n" and "m" represent constants, $V_{BE3}$ is the value of the voltage through a transistor, and $R_1$ and $R_2$ are the values of resistors. Referring to FIG. 2, $V_{BE3}$ is the base-emitter voltage of the third branch's transistor (46), RI is the value of the second branch's (38) resistor (72), and $R_2$ is the value of the third branch's (40) resistor (74). Those skilled in the art will appreciate that if $R_1$ and $R_2$ are equal, they cancel each other out in Equation 3, effectively having no effect on the value of vbgr.

Advantages of the present invention may include one or more of the following. In some embodiments, because a low supply voltage is used for a temperature-independent and temperature-dependent voltage generator, smaller circuit elements may be used to construct the temperature-independent and temperature-dependent voltage generator.

In some embodiments, because a startup circuit is used to stabilize a feedback input of a output stage of a temperature-independent and temperature-dependent voltage generator, the temperature-independent and temperature-dependent voltage generator may output a valid temperature-independent signal and a valid temperature-dependent signal.

In some embodiments, because an amplifier stage provides feedback to a delta-$V_{BE}$ current source produced by a output stage of a temperature-independent and temperature-dependent voltage generator, error within the delta-$V_{BE}$ current source may be minimized.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An apparatus for generating a temperature-dependent voltage and a temperature-independent voltage, comprising:

an amplifier stage that generates a feedback signal;

a startup stage that generates a startup signal dependent on the feedback signal, wherein the startup signal connects to the feedback signal; and an output stage that outputs the temperature-dependent voltage and the temperature-independent voltage dependent on the feedback and startup signals.

2. The apparatus of claim 1, wherein the output stage comprises a branch that outputs the temperature-dependent and temperature-independent voltages.

3. The apparatus of claim 2, wherein the branch and another branch form a current mirror.

4. The apparatus of claim 2, wherein the branch comprises a temperature-sensitive element that generates the temperature-dependent voltage.

5. The apparatus of claim 1, wherein the amplifier stage comprises a comparator that generates the feedback signal.

6. The apparatus of claim 1, wherein the startup stage comprises:

an inverter stage that generates an inverter stage output dependent on the feedback signal; and a switching element that generates the startup signal dependent on the inverter stage output.

7. An apparatus for generating a temperature-dependent voltage and a temperature-independent voltage, comprising:

means for generating a feedback signal;

means for generating a startup signal in relation to the feedback signal;

means for removing power supply noise from the feedback signal and the startup signal;

means for generating the temperature-independent voltage in relation to the feedback signal and the startup signal; and means for generating the temperature-dependent voltage in relation to the temperature-independent voltage.

8. The apparatus of claim 7, wherein the means for generating the feedback signal is dependent on a means for comparing a first temperature-sensitive voltage in relation to the feedback signal and the startup signal and a second temperature-sensitive voltage in relation to the feedback signal and the startup signal.

9. A method for generating a temperature-dependent voltage and a temperature-independent voltage using a voltage generator having a power supply, comprising:

generating a feedback signal;

generating a startup signal, wherein the startup signal connects to the feedback signal;

generating the temperature-independent voltage in relation to the feedback signal and the startup signal using a first temperature-sensitive element; and generating the temperature-dependent voltage in relation to the temperature-independent voltage, wherein the temperature-dependent voltage is generated using a second temperature-sensitive element.

10. A method for forcing a temperature-dependent and temperature-independent voltage generator out of a no-current state, comprising:

generating a first temperature-sensitive voltage;

generating a second temperature-sensitive voltage;

generating a feedback signal by comparing the first temperature-sensitive voltage to the second temperature-sensitive voltage;

generating a startup signal using the feedback signal; and inputting the startup signal to the feedback signal.

11. The method of claim 10, wherein the first temperature-sensitive voltage is generated by a first temperature-sensitive element.

12. The method of claim 11, wherein the second temperature-sensitive voltage is generated in relation to a second temperature-sensitive element.

* * * * *